US008115685B2

(12) United States Patent
Chen et al.

(10) Patent No.: US 8,115,685 B2
(45) Date of Patent: Feb. 14, 2012

(54) FLAT ANTENNA STRUCTURE

(75) Inventors: Shih-Hong Chen, Taipei Hsien (TW); Chi-Chung Chang, Taipei Hsien (TW)

(73) Assignee: Wistron Neweb Corp., Taipei Hsien (TW)

( * ) Notice: Subject to any disclaimer, the term of this patent is extended or adjusted under 35 U.S.C. 154(b) by 465 days.

(21) Appl. No.: 12/458,070

(22) Filed: Jun. 30, 2009

(65) Prior Publication Data

US 2010/0019975 A1 Jan. 28, 2010

(30) Foreign Application Priority Data

Jul. 23, 2008 (TW) ..... 97127903 A

(51) Int. Cl.
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS 4,701,763 A * 10/1987 Yamamoto et al. .... 343/700 MS
5,526,003 A * 6/1996 Ogawa et al. ..... 343/700 MS
6,262,682 B1 * 7/2001 Shibata ..... 343/700 MS

* cited by examiner

*Primary Examiner* — Dieu H Duong
(74) *Attorney, Agent, or Firm* — Bacon & Thomas, PLLC

(57) ABSTRACT

The invention relates to a flat antenna structure. The flat antenna structure includes a first metal plate, an intermediate layer, a metal ring, and a second metal plate. The intermediate layer has a first hole, and the intermediate layer is installed above and connected to the first metal plate. The metal ring is connected to the first metal plate through the first hole. The second metal plate has a second hole. The second metal plate is connected to the metal ring and the first metal plate. The intermediate layer and the metal ring are wrapped by the first metal plate and the second metal plate. The second metal plate can be electrically connected to the first metal plate via the metal ring, and a resonator is formed between the first metal plate and the second metal plate. A characteristic of the flat antenna can be adjusted by changing the diameters of the first hole and the metal ring.

20 Claims, 4 Drawing Sheets

FLAT ANTENNA STRUCTURE

BACKGROUND OF THE INVENTION

1. Field of the Invention

The present invention relates to a flat antenna structure and an electronic device having the flat antenna structure, and more particularly, the present invention relates to a flat antenna structure capable of adjusting antenna characteristics and an electronic device having the flat antenna structure.

2. Description of the Related Art

Wireless communication products are increasingly ubiquitous in everyday life. The antenna plays an important role in a wireless communication system for receiving and transmitting electromagnetic waves. There are several types of antenna. A flat antenna is both cheap and easy to connect to a circuit.

Currently, a flat antenna of the prior art is a circular plate made of Teflon compound with two parallel copper layers printed on opposite sides. Teflon is one kind of polytetrafluoroethylene resin. Because Teflon consists of carbon and fluorine without hydrogen, it will not react with oxygen. Teflon, which is heat-resistant, cold-resistant, corrosion-resistant, non-adhesive, and self-lubricative, has a low friction coefficient and a low dielectric constant. Teflon is usually used as the base material of the flat antenna due to this low dielectric constant.

Teflon is expensive and difficult to recycle, and the manufacturing processes may cause waste of materials. Therefore, a new antenna structure is required to solve problems of the prior art.

SUMMARY OF THE INVENTION

It is therefore an object of the present invention to provide a flat antenna structure using another material to replace Teflon.

It is another object of the present invention to provide a flat antenna structure capable of adjusting antenna characteristics.

To achieve the object mentioned above, the invention provides a flat antenna structure and an electronic device having the flat antenna structure. The flat antenna structure comprises a first metal plate, an intermediate layer, a metal ring, and a second metal plate. The intermediate layer has a first hole, and the intermediate layer is installed above and connected to the first metal plate. The metal ring is connected to the first metal plate through the first hole. The second metal plate has a second hole. The second metal plate is connected to the metal ring and the first metal plate. The intermediate layer and the metal ring are covered by the first metal plate and the second metal plate, wherein the second metal plate can be electrically connected to the first metal plate via the metal ring, and a resonator is formed between the first metal plate and the second metal plate. A characteristic of the flat antenna structure can be adjusted by changing the diameters of the first hole and the metal ring. In one embodiment of the invention, the intermediate layer is made of plastic instead of Teflon.

Other objects, advantages, and novel features of the present invention will become more apparent from the following detailed description when taken in conjunction with the accompanying drawings.

BRIEF DESCRIPTION OF THE DRAWINGS

These and other objects and advantages of the present invention will become apparent from the following description of the accompanying drawings, which disclose several embodiments of the present invention. It is to be understood that the drawings are to be used for purposes of illustration only, and not as a definition of the invention.

In the drawings, wherein similar reference numerals denote similar elements throughout the several views.

DETAILED DESCRIPTION OF THE PREFERRED EMBODIMENT

Figure 1:
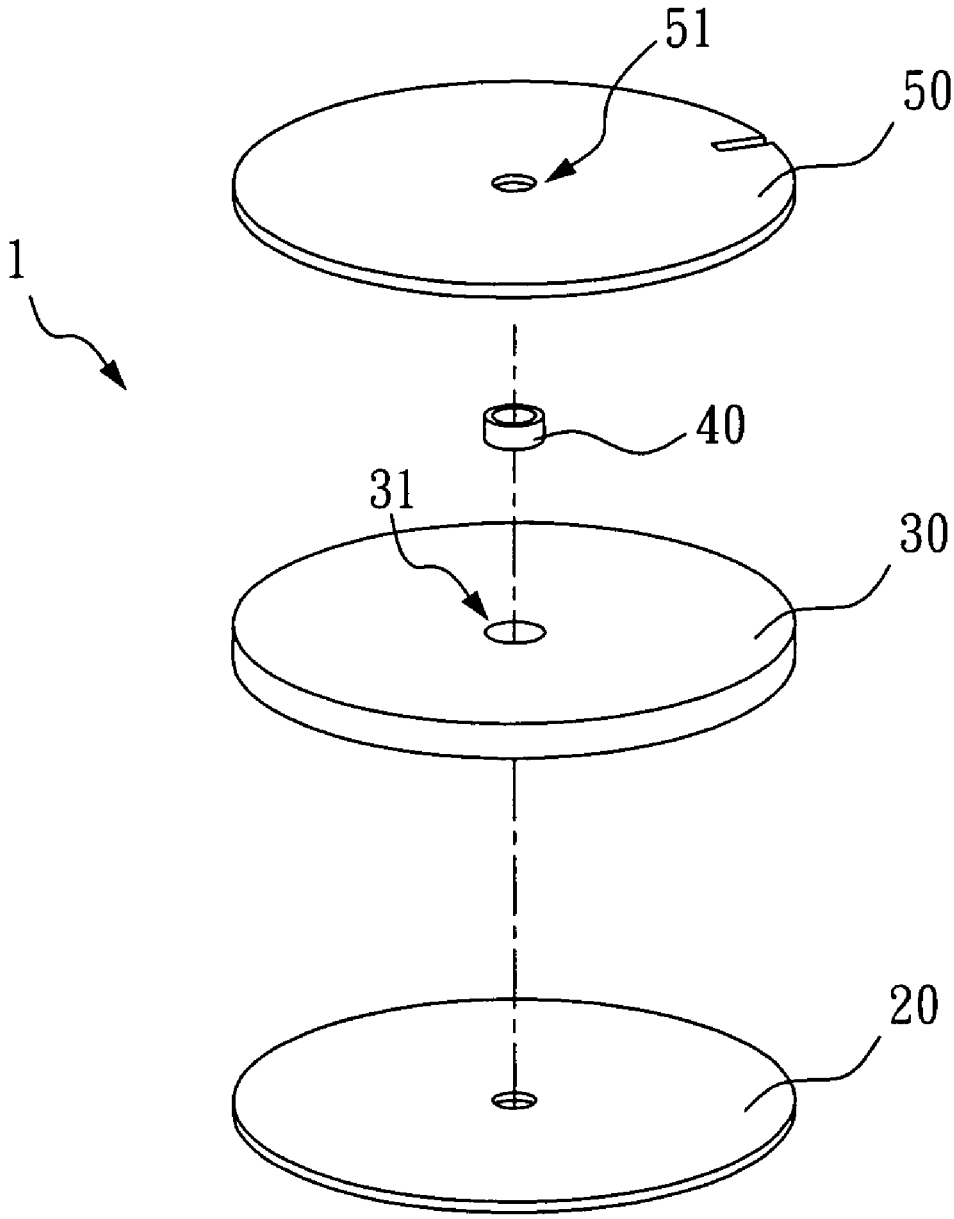
FIG. 1 is an exploded view of a flat antenna structure according to an embodiment of the invention.
Figure 2:
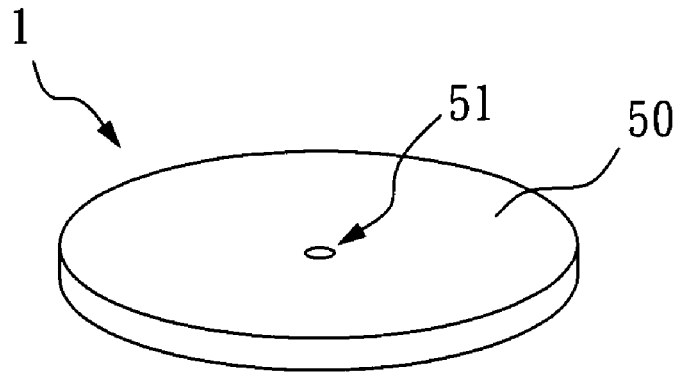
FIG. 2 is an illustration of the flat antenna structure according to an embodiment of the invention.
Figure 3:
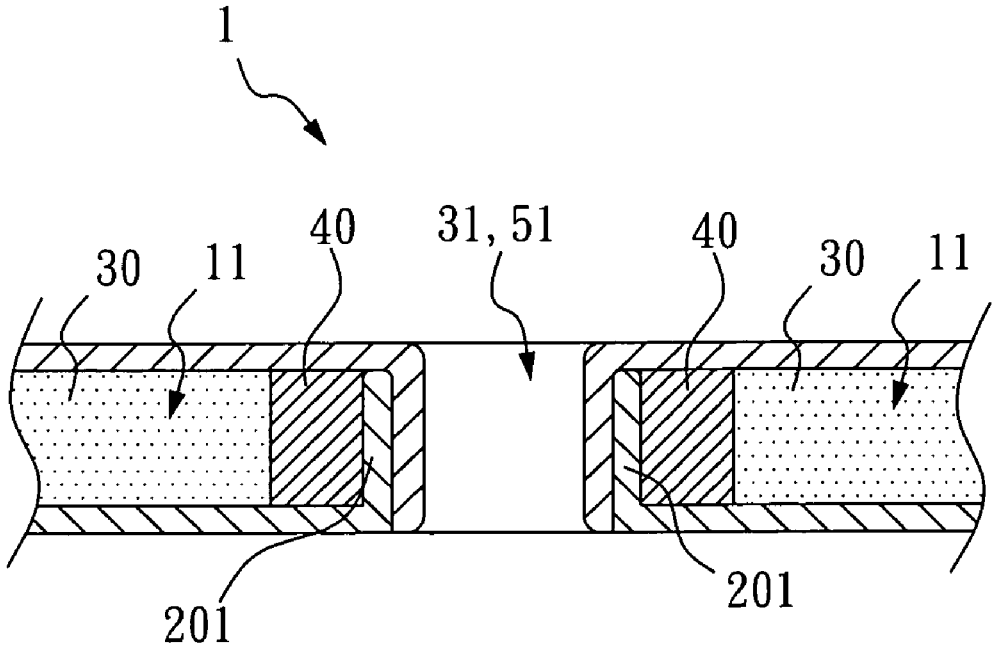
FIG. 3 is a cross-section view of the flat antenna structure according to an embodiment of the invention.

Please refer to FIG. 1 to FIG. 3. FIG. 1 is an exploded view of a flat antenna structure according to an embodiment of the invention. FIG. 2 is an illustration of the flat antenna structure according to an embodiment of the invention. FIG. 3 is a cross-section view of the flat antenna structure according to an embodiment of the invention.

As shown in FIG. 1 to FIG. 3, the flat antenna structure 1 comprises a first metal plate 20, an intermediate layer 30, a metal ring 40, and a second metal plate 50. The intermediate layer 30 has a first hole 31, and the intermediate layer 30 is installed above and connected to the first metal plate 20. The metal ring 40 is connected to the first metal plate 20 through the first hole 31. The second metal plate 50 has a second hole 51. The second metal plate 50 is connected to the metal ring 40. The second metal plate 50 is also connected to the first metal plate 20 by riveting in order to sandwich the intermediate layer 30 and the metal ring 40 between the first metal plate 20 and the second metal plate 50. The second metal plate 50 is electrically connected to the first metal plate 20 by riveting. The second metal plate 50 also can be electrically connected to the first metal plate 20 via the metal ring, As shown in FIG. 3, a resonator 11 is formed between the first metal plate 20 and the second metal plate 50. The characteristics of the flat antenna structure 1 can be adjusted by changing the diameters of the first hole 31 and the metal ring 40. Because changing the diameter of the metal ring 40 will change the size of the resonator 11, the antenna characteristics will change as well.

In one embodiment of the invention, the intermediate layer 30 is a plastic plate. The plastic material has a low dielectric constant; therefore, it can replace Teflon as the base material of the flat antenna structure 1. As shown in FIG. 3, in order to fasten the flat antenna structure 1, the first metal plate 20 is connected to the second metal plate 50 by riveting, but the invention is not limited to this connection method. In one embodiment of the invention, the intermediate layer 30 is made of high density polyethylene (HDPE), but the invention is not limited to this material.

Figure 4:
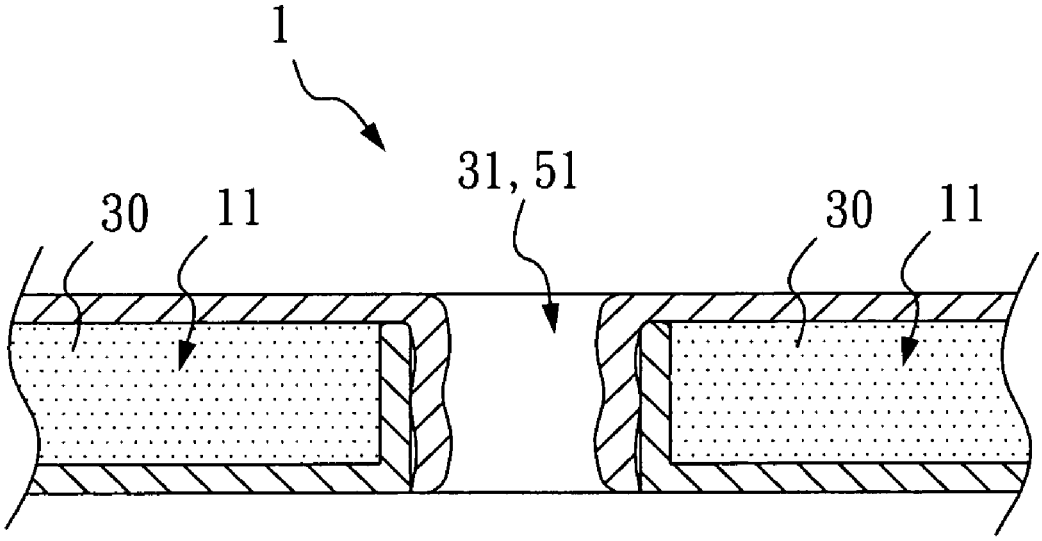
FIG. 4 is an illustration of the deformed flat antenna structure due to the lack of a metal ring.

As mentioned above, in addition to electrically connecting the first metal plate 20 and the second metal plate 50, changing the diameter of the metal ring 40 can adjust the antenna characteristics of the flat antenna structure 1. The metal ring 40 also can prevent deformation of the first metal plate 20 and the second metal plate 50 when the first metal plate 20 and the second metal plate 50 are riveted together. For example, as shown in FIG. 4, when riveting the first metal plate 20 and the second metal plate 50 together without the metal ring 40, the second metal plate 50 will be deformed due to the pressure of riveting.

As shown in FIG. 3, in one embodiment of the invention, the first metal plate 20 comprises a fixing part 201 corresponding to the metal ring 40 in order to connect the first metal plate 20 and the metal ring 40 by screwing. The intermediate layer 30 is connected to the first metal plate 20 and the second metal plate 50 by adhesion. For example, the first metal plate 20, the intermediate layer 30, and the second metal plate 50 can be stuck together with the double-sided tape, but the invention is not limited to this method of adhesion.

In one embodiment of the invention, the first metal plate 20, the second metal plate 50, and the metal ring 40 are made of copper or copper alloys, but the invention is not limited to these materials. For example, the first metal plate 20, the second metal plate 50, and the metal ring 40 can also be made of silver or silver alloys. As long as the material is a metal with good conductivity, it can be used as the material of the first metal plate 20, the second metal plate 50, and the metal ring 40.

Figure 5A:
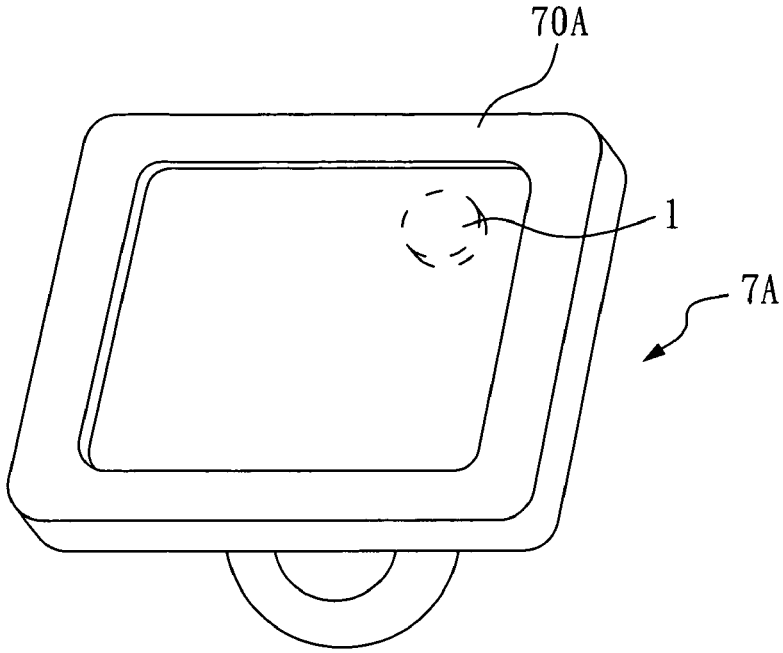
FIG. 5A is an illustration of an electronic device having the flat antenna structure according to an embodiment of the invention.
Figure 5B:
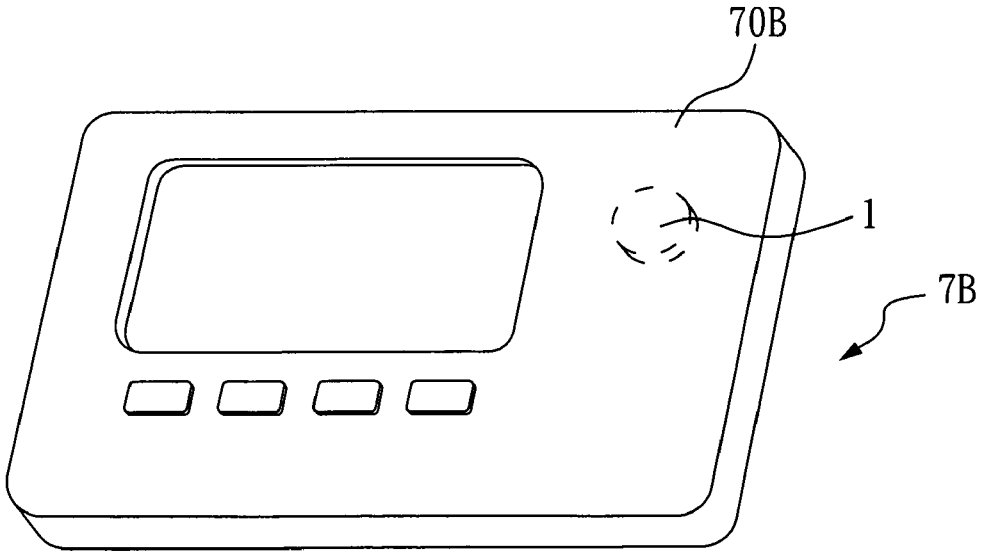
FIG. 5B is an illustration of another electronic device having the flat antenna structure according to an embodiment of the invention.

Please refer to FIG. 5A and FIG. 5B showing electronic devices having the flat antenna structure 1 according to an embodiment of the invention.

FIG. 5A is an illustration of an electronic device 7A having the flat antenna structure 1 according to an embodiment of the invention. The electronic device 7A comprises a main body 70A and the flat antenna structure 1. In one embodiment of the invention, the main body 70A is a global positioning system (GPS), but the invention is not limited to that application.

FIG. 5B is an illustration of an electronic device 7B having the flat antenna structure 1 according to an embodiment of the invention. The electronic device 7B comprises a main body 70B and the flat antenna structure 1. In one embodiment of the invention, the main body 70B is a satellite radio, but the invention is not limited to this application.

Although the present invention has been explained in relation to its preferred embodiments, it is to be understood that many other possible modifications and variations can be made without departing from the spirit and scope of the invention as hereinafter claimed.

What is claimed is:

1. A flat antenna structure comprising:

a first metal plate;

an intermediate layer having a first hole, the intermediate layer being installed above and connected to the first metal plate;

a metal ring connected to the first metal plate through the first hole; and a second metal plate having a second hole, the second metal plate being connected to the metal ring and the first metal plate, the intermediate layer and the metal ring being sandwiched by the first metal plate and the second metal plate;

wherein the second metal plate is electrically connected to the first metal plate via the metal ring, and a resonator is formed between the first metal plate and the second metal plate, a characteristic of the flat antenna structure is adjusted by changing the diameters of the first hole and the metal ring.

2. The flat antenna structure as claimed in claim 1, wherein the intermediate layer is a plastic plate.

3. The flat antenna structure as claimed in claim 1, wherein the intermediate layer is made of high density polyethylene (HDPE).

4. The flat antenna structure as claimed in claim 1, wherein the first metal plate is connected to the second metal plate by riveting.

5. The flat antenna structure as claimed in claim 1, wherein the first metal plate is connected to the metal ring by screwing.

6. The flat antenna structure as claimed in claim 1, wherein the intermediate layer is connected to the first metal plate and the second metal plate by adhesion.

7. The flat antenna structure as claimed in claim 1, wherein the first metal plate and the second metal plate are made of copper or copper alloys.

8. The flat antenna structure as claimed in claim 1, wherein the metal ring is made of copper or copper alloys.

9. The flat antenna structure as claimed in claim 1, wherein the first metal plate and the second metal plate are made of silver or silver alloys.

10. The flat antenna structure as claimed in claim 1, wherein the metal ring is made of silver or silver alloys.

11. An electronic device having a flat antenna structure, comprising:

a main body; and a flat antenna structure electrically connected to the main body, the flat antenna structure comprising:

a first metal plate; an intermediate layer having a first hole, the intermediate layer being installed above and connected to the first metal plate; a metal ring connected to the first metal plate through the first hole; and a second metal plate having a second hole, the second metal plate being connected to the metal ring and the first metal plate, the intermediate layer and the metal ring being sandwiched by the first metal plate and the second metal plate;

wherein the second metal plate is electrically connected to the first metal plate via the metal ring, and a resonator is formed between the first metal plate and the second metal plate, a characteristic of the flat antenna structure is adjusted by changing the diameters of the first hole and the metal ring.

12. The electronic device as claimed in claim 11, wherein the first metal plate is connected to the second metal plate by riveting.

13. The electronic device as claimed in claim 11, wherein the intermediate layer is a plastic plate.

14. The electronic device as claimed in claim 11, wherein the intermediate layer is made of high density polyethylene (HDPE).

15. The electronic device as claimed in claim 11, wherein the first metal plate is connected to the metal ring by screwing.

16. The electronic device as claimed in claim 11, wherein the intermediate layer is connected to the first metal plate and the second metal plate by adhesion.

17. The electronic device as claimed in claim 11, wherein the first metal plate and the second metal plate are made of copper or copper alloys.

18. The electronic device as claimed in claim 11, wherein the metal ring is made of copper or copper alloys.

19. The electronic device as claimed in claim 11, wherein the first metal plate and the second metal plate are made of silver or silver alloys.

20. The electronic device as claimed in claim 11, wherein the metal ring is made of silver or silver alloys.

* * * * *